United States Patent [19]

Fujimura

[11] 4,306,498

[45] Dec. 22, 1981

[54] INK-RETAINING SEALING ARTICLE

[75] Inventor: Kazuyuki Fujimura, Takasago, Japan

[73] Assignee: Bando Chemical Industries, Ltd., Hyogo, Japan

[21] Appl. No.: 151,862

[22] Filed: May 21, 1980

Related U.S. Application Data

[63] Continuation of Ser. No. 925,698, Jul. 17, 1978, abandoned, which is a continuation-in-part of Ser. No. 912,258, Jun. 5, 1978, abandoned, which is a continuation-in-part of Ser. No. 820,944, Aug. 1, 1977, abandoned.

[30] Foreign Application Priority Data

May 2, 1977 [JP] Japan ..... 52-51051

[51] Int. Cl.[3] ..... B41K 1/42

[52] U.S. Cl. ..... 101/333; 428/159; 428/315.7; 428/316.6; 428/321.3

[58] Field of Search ..... 428/306, 159, 160, 158, 428/108, 909, 305, 311, 229, 315, 280, 288, 290, 240, 245, 296, 317; 427/195; 118/264, 265, 266; 101/333, 401.1, 379, 367; 264/112, 113, 123, 126, 15, DIG. 7, 109

[56] References Cited

U.S. PATENT DOCUMENTS

| | | | |
|---|---|---|---|
| 2,526,311 | 10/1956 | Wilson | 101/368 |
| 3,336,244 | 8/1967 | Rockoff | 264/122 |
| 3,738,269 | 6/1973 | Wagner | 101/331 |
| 3,812,782 | 5/1974 | Funahashi | 101/367 |
| 3,905,295 | 9/1975 | Bielesch et al. | 101/331 |
| 3,923,936 | 12/1975 | Davis et al. | 101/348 |
| 3,955,499 | 5/1976 | Funahashi | 101/311 |
| 3,971,315 | 7/1976 | Hansen | 101/333 |

*Primary Examiner*—Stanley S. Silverman

*Attorney, Agent, or Firm*—Wenderoth, Lind & Ponack

[57] ABSTRACT

A stamping article which is capable of repeatedly stamping with liquid ink, said article consisting of:

(1) a stamping member having relief characters with a stamping surface and having a porosity of 20 to 50%, which is of porous structure and is produced by sintering a fine powder which is obtained by pulverizing a porous thermoplastic resin, (2) a base member capable of storing liquid ink and having a porosity of 60 to 80%, said base member comprising at least one material selected from the group porous, plastic foamed materials and fibrous, reticulate fabrics, which materials are co-fusible or bondable with said thermoplastic resin powder, said base member having a porosity 10–40% higher than said stamping member so as to insure a smooth flow of ink therebetween, said stamping member being fused with said base member.

5 Claims, 6 Drawing Figures

INK-RETAINING SEALING ARTICLE

This is a continuation of application Ser. No. 925,698, filed July 17, 1978, now abandoned, which in turn is a continuation-in-part of Ser. No. 912,258, filed June 5, 1978, now abandoned, which in turn is a continuation-in-part of Ser. No. 820,944, filed Aug. 1, 1977, now abandoned.

FIELD OF THE INVENTION

This invention relates to a porous, ink-retaining sealing article having relief characters.

DESCRIPTION OF THE PRIOR ART

Various processes are available for the manufacture of conventional porous, ink-retaining sealing articles having relief characters, such as (1) the extracting method which involves mixing a soluble, solid and fine powder, which can be dissolved and extracted by water or by solvents, with a rubber material or resin, forming such mixture into a sheet and then molding the sheet by means of heating and pressing, and finally extracting said solid and fine powder to form a continuous foam; (2) heating a porous, thermoplastic foam prepared beforehand and pressing it at a temperature such that molding is possible and then cooling down to form an article for seals; (3) the sintering method whereby a continuous foam is formed by bonding thermoplastic resin powder particles with one another by means of sintering at a temperature around the melting point.

However, referring to the extracting method (1), above, in order to obtain a pore structure of continuous porosity and voids suitable for absorbing and discharging ink, it is necessary to mix a large quantity of solid, very fine powder and extract it after molding. Accordingly, this method has disadvantages such that the physical properties of basic article for seals are diminished, time and equipment are required for mixing and extracting, dimensional change is caused by the extraction of the fine powder with resultant difficulty of obtaining a suitable material for seals of uniform quality. Moreover, the residual liquid from the extraction must be disposed of.

With regard to the method (2) above, it avoids the extraction process and can easily produce a porous material for seals having relief characters but cannot produce deep and acute-angled molding of relief characters (up to 0.4 mm.) because of the flexibility of foam. Even if the deep and acute-angled molding can be obtained by a high temperature and high pressure treatment, a problem is raised as to the molding of porous surface of characters and resultant reduction, by half, of the ink absorbing and discharging function.

The sintering method (3) above, avoids the extraction and other processes and can readily produce a porous article for seals, but since it sinters a thermoplastic resin powder which is not perfectly dissolved, it results in low strength and dimensional shrinkage in molding. Moreover, difficulty is encountered in manufacturing a suitable resin powder in large quantities, at low cost and in uniform quality.

Moreover, in the conventional sealing articles, a sealing member and an ink-retaining or an ink-supplying member are molded separately and both of them are adhered, e.g. with a binder. Accordingly, the conventional sealing device is complicated in construction and lacks unity, with the result that it does not absorb and discharge ink smoothly and lacks durability.

OBJECTS AND BRIEF SUMMARY OF THE INVENTION

It is an object of the present invention to eliminate the above-mentioned defects of the conventional sealing articles. It is a further object to provide an ink-retaining sealing article having excellent ink absorptivity and dischargeability and having deep and acute-angle relief characteristics.

The term "sealing" herein is synonymous with "printing".

The term "porosity" means the volume fraction of air in foam. "Porosity" is defined as follows:

$$\text{Porosity} = \left(1 - \frac{\text{Apparent density of foam}}{\text{Density of the material (polymer) formed by foam}}\right) \times 100\ (\%)$$

According to the present invention, the sealing member has a porosity of 20 to 60%, and is formed from a sintered fine powder produced by pulverizing a thermoplastic resin. The ink retaining and supplying member is formed from a porous, plastic foamed material or a fibrous and reticulate fabric and has a porosity of 40 to 90%.

The porosity of the ink retaining and supply base member must be higher than that of the sealing member and must be fusible and bondable with said thermoplastic resin powder for said sealing member, in order to exhibit uniform and adequate ink flow.

The ink retaining and supplying member and sealing member are thus fused together to form a unitary structure, in contrast to prior art sealing articles which joined these members with adhesives.

BRIEF DESCRIPTION OF THE DRAWINGS

The nature and advantages of the present invention will be understood more clearly from the following description made with reference to seven embodiment of the present invention and accompanying drawings, in which.

DETAILED DESCRIPTION OF PREFERRED EMBODIMENTS

The ink-retaining sealing article according to the present invention consists of a sealing member which is formed from the sintered thermoplastic resin powder and an ink-retaining and supplying base member integrated with said sealing member. The ink-retaining and supplying member is made from a porous, plastic foam or fibrous and reticulate fabric. The ink-retaining and supplying member has a porosity of 40 to 90% and desirably, an ink retentivity of 95–100% in the porous part of the foam. It is necessary that the ink retaining and supply base have a higher porosity than the sealing member to insure a smooth flow of ink therebetween and to the article being printed. This porosity differential is in the order of about 10%~70%, desirably 10~40%.

The above-mentioned thermoplastic resin powder can be obtained by pulverizing a gelated or semi-gelated foamed or non-foamed polyvinyl chloride composition, but ethylene vinyl acetate copolymer (EVA), thermoplastic polyester elastomer, thermoplastic polyurethane elastomer, etc. can be used.

Figure 6:
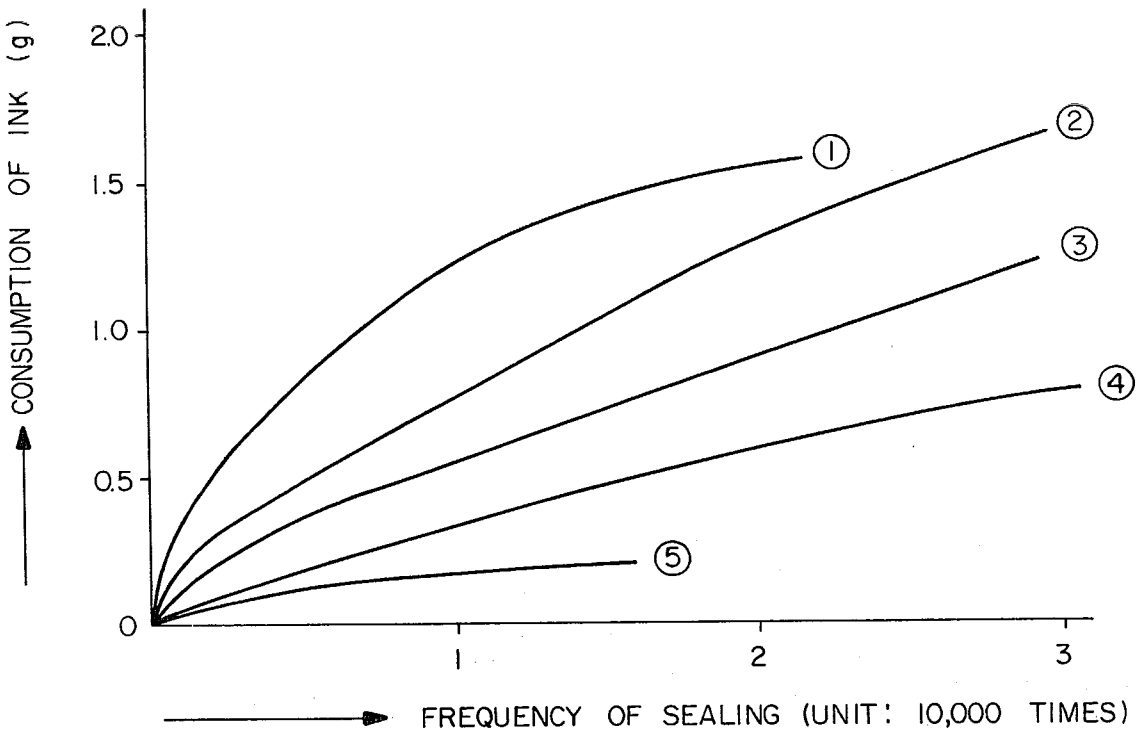
FIG. 6 is a graph depicting ink consumption vs. frequency of sealing for embodiments within and outside the present invention.

The importance of controlling the relative porosity of the sealing and ink retaining members can be seen from FIG. 6 which plots the ink consumption (g) vs. frequency of sealing, up to 10,000 times. Embodiments 1 and 5 have porosities outside the present claims as shown in the following table:

| | | (1) | (2) | (3) | (4) | (5) |
|---|---|---|---|---|---|---|
| Foam porosity percentage (%) | A | 80 | 80 | 60 | 60 | 30 |
| | B | 70 | 50 | 50 | 20 | 20 |
| Diameter of pore (or particle) (μ) | A | 10~100 | 10~100 | 10~100 | 10~100 | 10~100 |
| | B | 5~50 | 5~50 | 5~50 | 5~50 | 5~50 |

A - Ink-retaining and supplying member
B - Sealing member

The foregoing relation between the frequency of sealing and consumption of ink is of course influenced by the seal's shape and size of characters, designs, etc., sealing condition and characteristics of ink used, but in general, it can safely be said that:

In embodiment (1), due to larger consumption of ink in the initial stage, it is impossible to maintain clear sealing for a long period.

In embodiment (5), ink will not ooze out smoothly at all times. Accordingly, consumption of ink is small and clear sealing cannot be obtained.

In embodiments (2), (3) and (4), ideal ink consuming behavior is shown. Thus, ink is consumed at a suitable and uniform rate throughout use. Thus, the depth of sealed color remains unchanged and the sealing article is able to fulfill its function.

Referring to the method of making sealing material according to the present invention, a thermoplastic resin powder, such as a powder obtained by pulverizing gelated or semi-gelated foamed polyvinyl chloride composition, is filled in cavities of characters of a parent mold and is preheated. Then, a base member consisting of a porous foam or fibrous, reticulate fabric, which is co-fusible or bondable with said thermoplastic resin powder or powder of similar quality, is placed upon said preheated thermoplastic resin powder and both are subjected to heating and pressing, whereby said thermoplastic resin powder is sintered to form a foam sealing article having a sealing surface in a shape corresponding to said cavities of the desired characters. The ink retaining and supply base is integrally adhered to said sintered foam.

As the above-mentioned basic member for ink-retaining and supplying, elastic bodies of continuous porosity having excellent ink-retaining and supplying function (porous foam), such as the foam of plasticized polyvinyl chloride resins, EVA, synthetic rubber and urethane, and even non-woven fabrics of fibrous and reticulate construction can be used.

EMBODIMENT NO. 1

| | |
|---|---|
| Polyvinyl chloride (paste resin) | 100 parts by weight |
| DOP | 40 parts by weight |
| BBP | 30 parts by weight |
| DOA | 5 parts by weight |
| Foam stabilizer (surfactant) | 10 parts by weight |
| Stabilizer | 2 parts by weight |

A plastisol is prepared by stirring the above composition. A gas, such as air, is mixed and dispersed in the plastisol by means of a continuous foaming machine to produce a mechanically foamed plastisol. This foam is poured into a metallic mold of 2–10 mm thickness for molding. After molding, the molded foam is heated in an oven for 5–30 minutes at 125°–165° C., to be gelated or semi-gelated and it is taken out of the metallic mold. The foam thus obtained is a continuous foam having uniform and fine foam structure and also having such a fragile physical condition that it can easily be pulverized because of its gelation or semi-gelation. The foam obtained in this embodiment has density of 0.390 (g/cm$^3$) and pores of 10–100 μ, but its density, pore diameter, etc. can be varied by varying the type of resin, type of plasticizer, type of surfactant and combination thereof or the quantity of air to be admixed. Then, the above-mentioned gelated or semi-gelated foam is pulverized physically and is passed through a sieve of 40-mesh or finer. The powder thus obtained is a porous powder to be used for molding the sealing member according to the present invention.

Next, the powder obtained in the above manner is filled uniformly into the cavities of characters of the parent mold in a framework and is pre-heated in a heating press at 165° C. The above-mentioned parent mold has characters with 1.5 mm deep cavities and a shoulder angle of 105° (the angle formed between the base and the side of a cavity of character). Then, flexible foam is placed upon the above-mentioned powder which has been warmed to some degree by pre-heating and both are heated and pressed for 4–5 minutes at 165° C. and then cooled down to the room temperature. In this case, pressure to be applied is set at such a degree that flexible foam is compressed by 5–25%.

As the above-mentioned flexible foam, those which have elasticity and are adhesive to thermoplastic resin powder by heating, such as polyvinyl chloride foam, urethane foam, rubber foam, EVA foam, polyethylene foam, polyvinyl formalin foam, etc. can be used.

Finally, the powder and flexible foam treated in the above way and cooled down are taken out of the parent mold to form a porous article for relief seals having acute-angled characters of 1.4 mm in height and 105° in shoulder angle.

Figure 1:
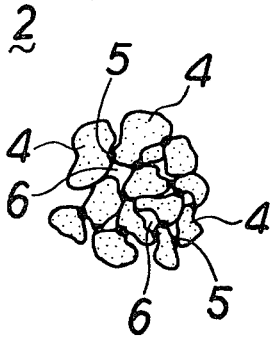
FIG. 1 shows, on an enlarged scale, the state in which porous powder particles bond together by sintering.
Figure 2:
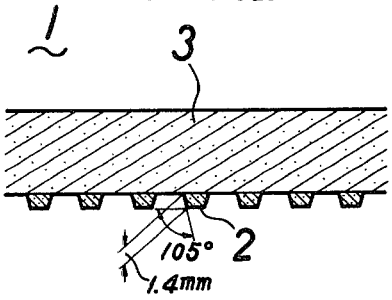
FIGS. 2 to 5 are respectively a cross-section showing an example of ink-retaining sealing articles according to the present invention.

As shown in FIG. 2, the article for seals 1 obtained in this embodiment has a sealing member of sintered foam 2 having a porosity of 20–50% and an ink-retaining and supplying member of flexible foam 3 having a porosity of 40~70% and both are fused together. As shown by FIG. 1, the sintered foam 2 consists of thermoplastic gelated or semi-gelated powder 4 in irregular shape partially fused together with a gap 6 therebetween. Numeral 5 denotes the area in which two powder particles are fused together.

EMBODIMENT NO. 2

In this embodiment, instead of the flexible foam in Embodiment No. 1, a non-woven fabric having high ink self-absorptivity, high ink retentivity, large ink holding capacity and elasticity, or such non-woven fabric bonded with the above-mentioned flexible foam is used. In the same way as in Embodiment No. 1, both the powder and the base member are heated and pressed to produce an article for relief seals having high ink absorptivity and dischargeability. In the case where a single layer of non-woven fabric is used, if a porous powder, as used in Embodiment No. 1, is filled in the concave portions of characters of the parent mold and is additionally overlaid thereupon in the thickness of 1–2 mm, effective adhesion to the non-woven fabric will be obtained. Since the above-mentioned non-woven fabric is required to withstand the processing conditions encountered in molding an article for seals (heating and pressing for 2–15 minutes at 180° C.), it should be a non-woven fabric of nylon, polyethylene, vinylon, wood fiber, etc. of binder coupling or of resin impregnating density of 0.10–0.20 (g/cm$^3$).

The characteristics of ink absorptivity and retentivity of the flexible foam and non-woven fabric used in Embodiments No. 1 and No. 2 respectively are shown in the following table.

| | Flexible foam | Non-woven fabric |
|---|---|---|
| Porosity | 60% | 40–90% |
| Ink absorbing speed (sec./mg) | 4 | 0.4 |
| Ink holding capacity (g/cm$^3$) | 0.6 | 0.6–0.9 |

Figure 3:
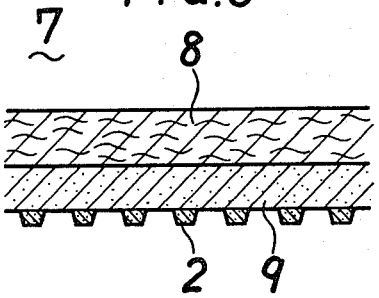
Figure 4:
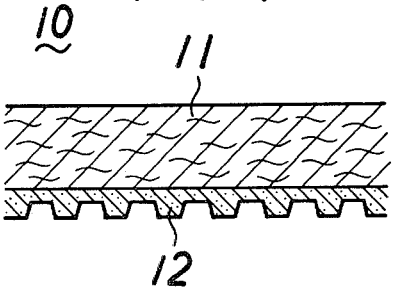

The article for seals obtained in Embodiment No. 2 is shown in FIG. 3 and FIG. 4. The article for seals 7 shown in FIG. 3 consists of non-woven fabric 8 and flexible foam 9 bonded with each other. As in the case of Embodiment No. 1, sintered foam 2 forming the sealing member has deep and acute-angled relief characters (1.4 mm in height and 105° in shoulder angle). FIG. 4 shows article for seals having a single layer of non-woven fabric 11 and a sintered foam 12 adhered to the underside of the non-woven fabric 11. This foam 12 is thicker than the foam 2 in Embodiment No. 1 for better adhesion.

EMBODIMENT NO. 3

As the thermoplastic elastomer, ethylene vinyl acetate copolymer (EVA) ("Meltisodex 30" made by Mitsui Polychemical, Ltd., containing 33% vinyl acetate in weight) is cold-pulverized in liquid nitrogen (−195° C.) by a cold-pulverizing machine. In this case, the pulverizing operation is repeated until the copolymer is pulverized to such an extent that particles pass through a sieve of 200-mesh. Thus, powder of 200-mesh grain size is obtained. This powder has a bulk specific gravity of 0.25–0.30 g/cm$^3$.

Then, the above-mentioned powder is filled in the cavities of characters (1.4 mm in depth and 105° in shoulder angle) of the parent mold and polyvinyl formal foam (PVF—"NUA-3200" made by Kanebo Synthetic Chemical, Ltd., 5 mm in thickness, 0.15 g/cm$^3$ in density and 88% in porosity) is laid thereon. These are pre-heated for one minute at 120° C. and then are subjected to heating and pressing (at such pressure that the above-mentioned PVF foam shows a compressibility of 15%) for 30 minutes at 120° C., whereby a relief article for seals is obtained. The EVA copolymer has a porosity of 40%. The article for seals obtained in this embodiment has construction similar to that of the article for seals 1 in Embodiment No. 1 (refer to FIG. 2).

EMBODIMENT NO. 4

In this embodiment, the powder as used in Embodiment No. 3 is filled in cavities of characters of the parent mold and a rubber convex plate molded by the parent mold is fixed in the cavities of characters for compressing the filled-in powder and then powder is further filled in the cavities of characters. Thereafter, the same process as in the case of Embodiment No. 3 is carried out to obtain an article for seals. The article for seals obtained in this embodiment has a larger percentage of powder filling in the surface of sealing part than in the case of Embodiment No. 3 and accordingly has a sealing member of better sharpness.

Figure 5:
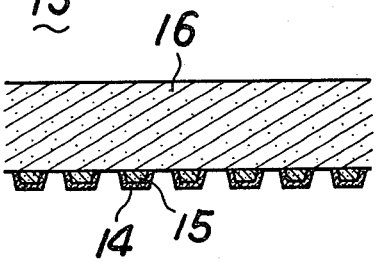

As shown in FIG. 5, an article for seals 13 in Embodiment No. 4 has foam layers 14 of high density at the surface part of the sealing member and the other part is formed with sintered foam 15 as in the case of Embodiment No. 1. These two parts and an ink-retaining and supplying base member formed with PVF foam 16 are bonded together.

EMBODIMENT NO. 5

In this embodiment, powder as used in Embodiment No. 3 is filled in cavities of characters of the parent mold, upon which powder is further laid in a thickness of 1–2 mm. Thereafter, the same process as in the case of Embodiment No. 3 is carried out to obtain an article for seals. According to this embodiment, an article for seals having very close adherence of the sintered powder forming the foam sealing member and the PVF foam forming the ink-retaining and supplying base member can be obtained. The article for seals in this embodiment has a construction similar to that of the article for seals 10 shown in FIG. 4.

EMBODIMENT NO. 6

In this embodiment, a thermoplastic polyester elastomer ("Pelplen P40B" made by Toyoboseki, Ltd.) is made into a powder of 200-mesh grain size in the same way as Embodiment No. 3. This powder is filled in the cavities of characters of the parent mold and is preheated for one minute at 175° C. Upon this powder, is placed a foam of the same quality obtained by the salt extraction method (300 weight parts of 200-mesh common salt powder is kneaded at 185° C., in the presence of 30 weight parts of high molecular weight polyester plasticizer as a plasticizer, by a vinyl roll and then the common salt is extracted by water to obtain a foam of 5 mm in thickness) and both are subjected to heating and pressing for 10 minutes at 170° C. and at a pressure under which the foam shows compressibility of 10%, whereupon a relief article for seals is obtained. The article for seals obtained in this embodiment has construction similar to that of the article for seals 1 in Embodiment No. 1.

EMBODIMENT NO. 7

In this embodiment, thermoplastic urethane elastomer ("Elastolan E 180 FNAT" made by Japan Elastolan, Ltd.) is made into 20% dimethyl formamide solution, which is applied onto a glass sheet in thickness of 0.1 mm. This coated glass sheet is soaked in water to obtain a film-like substance, which is then soaked in a 30% dimethyl formamide aqueous solution at 40° C. and is dried after extraction of dimethyl formamide. This film-like substance is pulverized by a grinder. The powder thus obtained is passed through a sieve of 100-mesh to form a powder for the formation of the sealing member.

Then, the above-mentioned powder is filled in the cavities of the characters of the parent mold and is pre-heated for 3 minutes at 150° C. Upon this pre-heated powder, is placed a non-woven fabric of 3 mm in thickness (non-woven fabric made of polyester fiber and NBR latex, having density of 0.3 g/cm$^3$) and both are subjected to heating and pressing for 10 minutes at 150° C. to obtain a sealing article.

In sum, the principle of molding the sealing article according to the present invention is that since the thermoplastic resin powder filled in the cavities of the characters of the parent mold is pressed fully and uniformly by an elastic body (porous foam or fibrous and reticulate fabrics) harder than said powder, the thermoplastic resin powder is molded into characters exactly along the cavities. In the above-mentioned Embodiments No. 1 and No. 2, porous fine powder (gelated or semi-gelated polyvinyl chloride compound powder) is used to form the base member. The porous, fine powder has advantages such that it remains porous even after it is subjected to sintering and powder particles bond together firmly by fusing with pores larger than those in powder itself left therebetween (refer to FIG. 1), with the result that porous relief article for seals having high porosity, sealability and ink-absorptivity and dischargeability can be obtained.

Moreover, because the article for seals according to the present invention is an integrated mold of the above-mentioned sintered foam and flexible, porous foam or elastic non-woven fabric (fibrous and reticulate fabric), it absorbs and discharges ink smoothly and has large ink retaining capacity. In addition, depending upon the selection of the above-mentioned base member, physical properties such as resistance to low temperature, resistance to oil, durability, etc. can be improved.

Since the ink-retaining sealing article according to the present invention is an integrated mold consisting of a sealing member which is a foam formed from the sintered thermoplastic resin powder and an ink-retaining and supplying base member made of porous foam or fibrous, reticulate fabric which is co-fusible and bondable with the above-mentioned thermoplastic resin powder or powder of similar quality, it absorbs and discharges ink smoothly, is free from irregular sealing, has high durability, affords ease of ink supply and makes it possible to carry out brilliant sealing of constant shade in a continuous sealing.

Furthermore, as compared with the conventional method of preparing a molded sealing article, since the present invention involves the filling of thermoplastic resin fine powder in cavities of characters of the parent mold and the use of porous foam or elastic non-woven fabric (fibrous, reticulate fabrics) as the basic member, when both the powder and the base member are subjected to heating and pressing, the fine powder flows into the mold smoothly. As the fine powder is pressed uniformly with a base member larger than that, molding of relief characters can be made as high as 1.4 mm (formerly, up to about 0.4 mm) and an acute-angled sealing surface can be formed. Besides, it enables one to easily obtain an article for seals having porous relief characters, without the necessity of extracting and other processes after molding. Especially when the thermoplastic resin powder obtained by pulverizing gelated or semi-gelated foamed polyvinyl chloride is used, one can now produce articles for seals having high ink-absorptivity and dischargeability, acute angles and deep moldability, high durability, with ease of manufacture.

The ink-retaining sealing article according to the present invention is applicable to a porous roll for the purpose of absorbing and discharging liquid, porous molds of complicated shape, etc.

I claim:

1. A stamping article which is capable of repeatedly stamping with liquid ink, said article consisting of:

(1) a stamping member having relief characters with a stamping surface and having a porosity of 20 to 50%, which is of porous structure and is produced by sintering a fine powder which is obtained by pulverizing a porous thermoplastic resin, (2) a base member capable of storing liquid ink and having a porosity of 60 to 80%, said base member comprising at least one material selected from the group porous, plastic foamed materials and fibrous, reticulate fabrics, which materials are cofusible or bondable with said thermoplastic resin powder, said base member having a porosity 10–40% higher than said stamping member so as to insure a smooth flow of ink therebetween, said stamping member being fused with said base member.

2. The stamping article as defined in claim 1, wherein the thermoplastic resin powder is a powder produced by pulverizing a plastic foam selected from the group of gelated materials and semi-gelated materials comprising plasticized polyvinyl chloride.

3. The stamping article as defined in claim 1, which contains a supply of liquid ink therein.

4. The stamping article according to claim 1 wherein said thermoplastic powder has a bulk specific gravity of 0.25–0.30 g/cm$^3$.

5. The stamping article according to claim 1 wherein the stamping member has a porosity of from about 5 to 50 microns and the base member has a porosity of from about 10 to 100 microns.

* * * * *